US006609901B2

(12) United States Patent
Bussmann

(10) Patent No.: US 6,609,901 B2
(45) Date of Patent: Aug. 26, 2003

(54) CLOSURE SYSTEM FOR PUMP CASINGS OF PLASTIC IMMERSION PUMPS

(75) Inventor: Peter Bussmann, Mumpf (CH)

(73) Assignee: BABCO GmbH, Rheinfelden (CH)

( * ) Notice: Subject to any disclaimer, the term of this patent is extended or adjusted under 35 U.S.C. 154(b) by 0 days.

(21) Appl. No.: 10/032,674

(22) Filed: Oct. 25, 2001

(65) Prior Publication Data

US 2002/0094288 A1 Jul. 18, 2002

(30) Foreign Application Priority Data

Oct. 27, 2000 (CH) ..... 2106/00

(51) Int. Cl.[7] ..... F04B 39/12
(52) U.S. Cl. ..... 417/572; 417/423.14; 418/270
(58) Field of Search ..... 417/572, 423.14; 418/270

(56) References Cited

U.S. PATENT DOCUMENTS 2,834,299 A * 5/1958 Coffey ..... 417/572
2,855,141 A * 10/1958 Van Rijn ..... 417/423.14
3,674,378 A * 7/1972 Erickson ..... 416/177
4,167,941 A * 9/1979 Capra et al. ..... 128/200.23
5,049,770 A * 9/1991 Gaeth et al. ..... 310/89
5,833,441 A * 11/1998 Danish et al. ..... 417/423.14
2002/0081209 A1 * 6/2002 Yang ..... 417/63

* cited by examiner

*Primary Examiner*—Charles G. Freay
*Assistant Examiner*—Emmanuel Sayoc
(74) *Attorney, Agent, or Firm*—Sidley Austin Brown & Wood, LLP

(57) ABSTRACT

The closure system according to the invention is intended in particular for plastics immersion pumps which in turn have a pump casing which has a substantially cylindrical casing wall, a detachable casing cover and a locking ring which is intended for closing the casing cover and, in the mounted state, is arranged on the outside of the casing cover and is inserted in an annular groove of the casing wall. According to the invention, the casing cover is provided on its outside with at least two ribs which are arranged in a spoke-like manner and each have an outer projection and with this each expose a groove radially accessible from the outside, and the locking ring is provided with the same number of radially inward projecting tabs. The latter are dimensioned and arranged in such a way that, in the assembled, i.e. operational, state of the pump, they are each inserted in a tightly fitting manner into a groove of the ribs arranged at the end face of the casing cover. The closure system according to the invention is distinguished in particular by the fact that, in the closed state, the locking ring is clamped at preferably uniform distances from the ribs of the casing cover and is thus secured radially and axially and also against an undesired deformation.

3 Claims, 2 Drawing Sheets

CLOSURE SYSTEM FOR PUMP CASINGS OF PLASTIC IMMERSION PUMPS

BACKGROUND OF THE INVENTION

1. Field of the Invention

The present invention relates to a closure system for cylindrical plastics casings.

A cylindrical plastics casing is understood as meaning, for example, the casing of a plastics immersion pump which substantially has a cylindrical casing wall and a casing cover. In the context of the invention, however, it may also be another cylindrical casing which in particular must be closed in a secure and pressure-resistant manner over a relatively long period.

2. Description of the Prior Art

Today, various closure systems are used for closing the pump casing of a plastics immersion pump. In particular, the use of at least one locking ring is known. This is mounted on the substantially circular casing cover, which in turn rests on an annular stop of the casing wall and closes the pump casing at the end. In the case of this known closure system, the cylindrical casing wall is additionally provided, on its end section projecting beyond the fastening region of the casing cover, with an all-round annular groove into which said securing ring is inserted.

Particularly in the case of plastics immersion pumps, the problem arises where the casing is to be closed with the securing ring in such a way that the casing cover is not forced out of the pump casing by the delivery pressure of the pump even at maximum operating pressure, at maximum operating temperature and also after a decline in the clamping force of the locking ring. This is prevented in the case of some known immersion pumps by a plurality of ribs which are arranged in the manner of spokes on the outside of the casing cover and are dimensioned in such a way that they are flush with the locking ring at the end face and thus permit fixing of the locking ring by means of plastics screws inserted into the ribs. The forcing of the locking ring out of the groove in the casing wall and hence separation of the casing cover is thus prevented in this case by fixing means mounted on the outside. However, this known solution is insufficient and unsatisfactory since the small threads in the ribs and the plastics screws are susceptible to faults and their installation is time-consuming.

SUMMARY OF THE INVENTION

It is the object of the present invention to provide a novel closure system which has a locking ring detachable from said system and does not have the disadvantages of the closure systems described above. In particular, the function of the closure system is to be improved compared with the known system in such a way that the locking ring is secured both radially and axially in the inserted and assembled state.

This object is achieved by a closure system for cylindrical plastics casings, in particular pump casings of plastics immersion pumps, which system has a substantially cylindrical casing wall, a detachable casing cover and a locking ring which is intended for closing the casing cover and, in the mounted state, is arranged on the outside of the casing cover and is inserted into an annular groove in the casing wall, the casing cover being provided on its outside with at least two ribs which are arranged in a spoke-like manner and each have an outer projection and with this each expose a groove radially accessible from the outside, the locking ring being provided with the same number of radially inward projecting tabs as ribs possessed by the casing cover, and being capable of being brought into a locking position by rotation on the casing cover, and the tabs being dimensioned and arranged in such a way that, in the locking position, they are each inserted with a tight fit into a groove of the ribs arranged on the end face of the casing cover.

As in the case of the known systems, the closure system according to the invention is formed from the casing cover and the locking ring. However, it is distinguished therefrom substantially in that, in the mounted state, i.e. in the closed state of the casing cover, the locking ring engages both the casing wall and the ribs of the casing cover.

According to the invention, the casing cover is provided with at least two ribs which are arranged in a spoke-like manner and each have an outer projection and with this each expose a groove radially accessible from the outside. In comparison, the locking ring has two ends which are adjacent to one another and can be pressed against one another for insertion into the groove of the casing wall, and said locking ring is provided with the same number of radially inward projecting tabs as the ribs possessed by the casing cover. According to the invention, the tabs of the locking ring are dimensioned and arranged in such a way that, in the mounted state, i.e. closed state of the casing cover, they are each inserted with a tight fit into a groove of the ribs arranged at the end face of the casing cover.

In preferred embodiments of the invention, the casing cover has six, eight or twelve ribs arranged at regular intervals radially symmetrically to one another and the locking ring likewise has six, eight or twelve matching tabs. Furthermore, the width of the tabs is preferably about ⅔ of the outermost radial spacing of the ribs.

BRIEF DESCRIPTION OF THE DRAWINGS

The subject of the invention is now described in more detail with reference to an embodiment shown in the drawing. In the drawing.

DESCRIPTION OF THE PREFERRED EMBODIMENT

Figure 1:
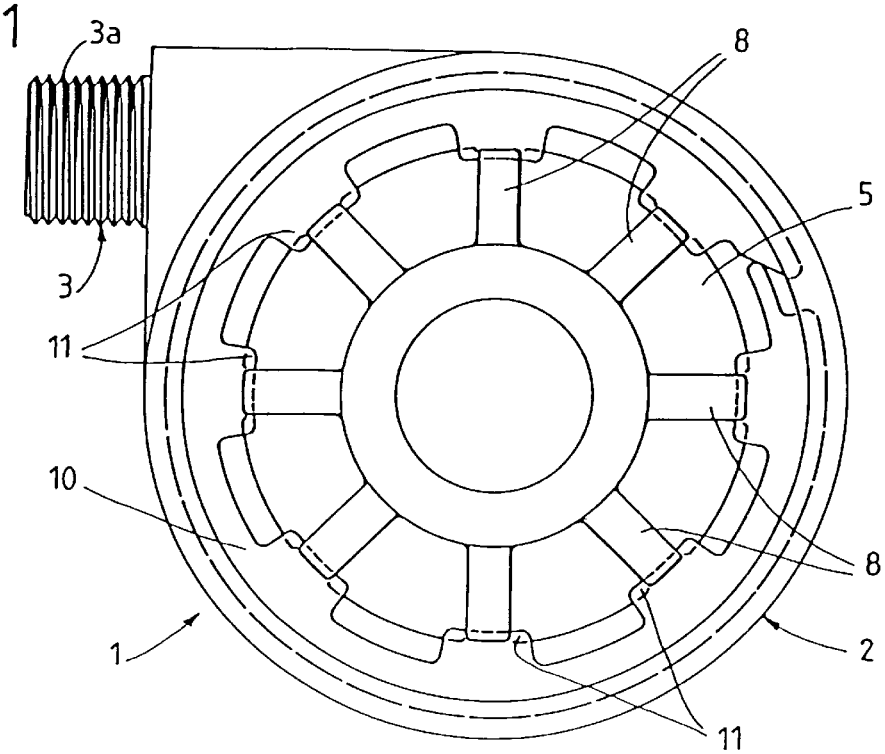
FIG. 1 shows a plan view of the pump casing of a plastics immersion pump with closed casing cover.
Figure 2:
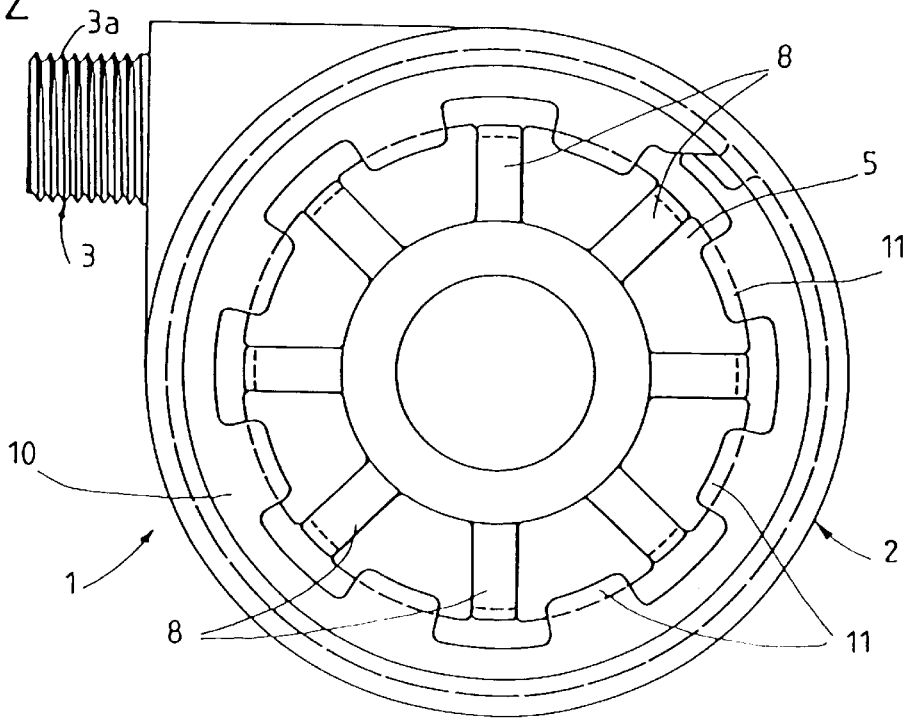
FIG. 2 shows a plan view of the pump casing of FIG. 1 with locking ring released from the ribs of the casing cover and FIG. 3 shows a cross-section through the pump casing of FIG. 1.
Figure 3:
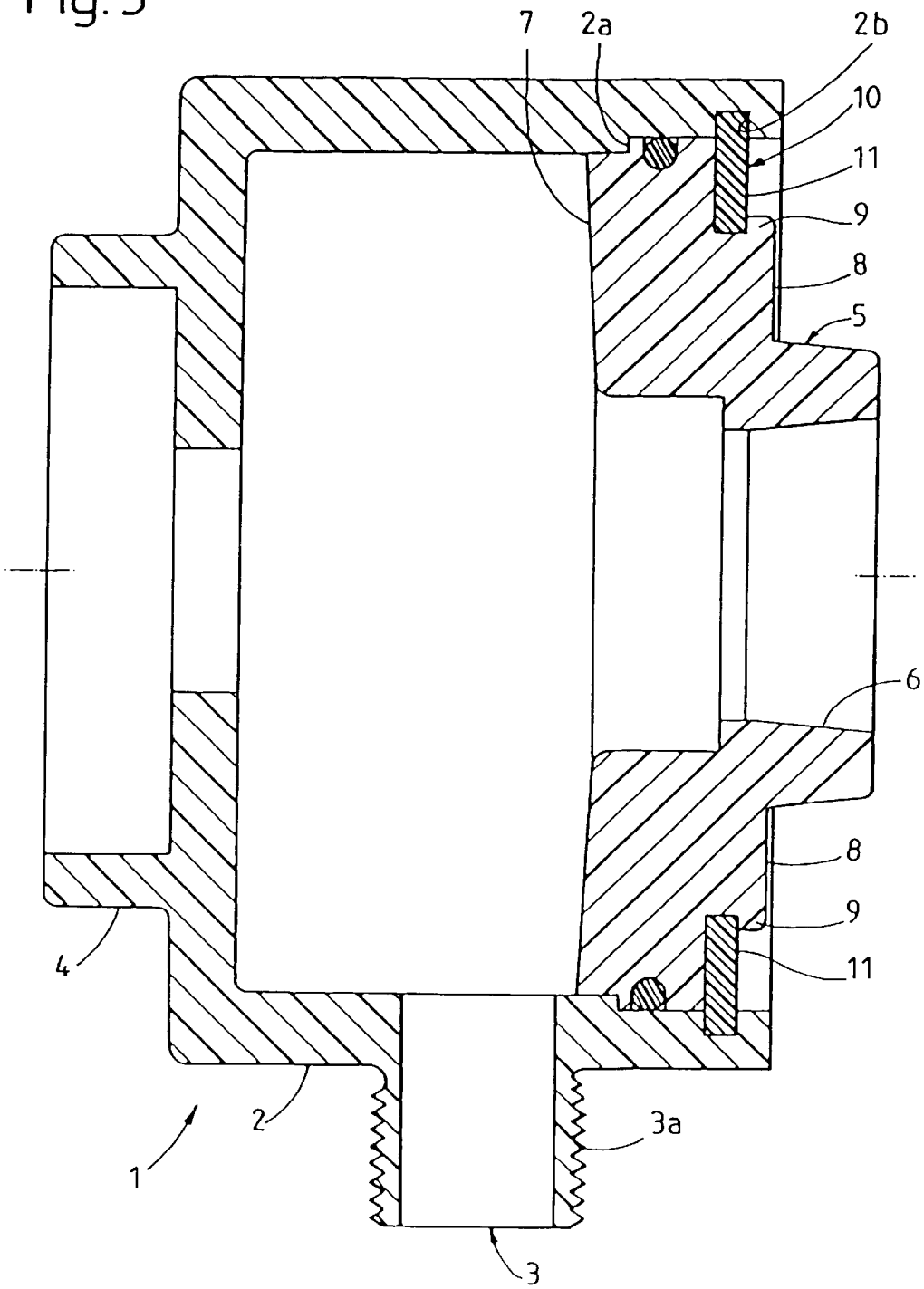

The pump casing of the plastics immersion pump, shown in FIGS. 1 to 3 and denoted as a whole by 1, has a substantially cylindrical casing wall 2, two connections 3 and 4 and a casing cover 5.

The connection 3 additionally has an external thread 3*a* for fastening a connection piece, and the casing cover 5 provided with a central passage 6 rests with its annular fastening part 7 on a circular stop 2*a* of the cylindrical casing wall 2, and does so in a manner already known from the prior art.

The casing cover 5 furthermore has, on its outside, eight radial ribs 8 which are arranged in a spoke-like manner and equal distances apart and each have an outer projection 9 and with this each expose a groove radially accessible from the outside.

A locking ring 10 resting on the casing cover 5 and fitting in an all-round annular groove 2*b* of the casing wall 2 is provided with eight radially inward projecting tabs 11 in such a way that, as illustrated in FIGS. 1 and 2, they are each inserted in a tightly fitting manner into a groove of a rib 8 in the closed state and rest in each case between two ribs 8 in the released state, in particular the width of the tabs 11 being, for example, about ⅔ of the outermost radial spacing of the ribs 8.

All parts of the pump casing consist of a plastic, for example a thermoplastic.

During assembly, after the insertion of the casing cover 5 into the pump casing 1, the locking ring 10 is radially compressed and is pressed into the groove 2*b* of the casing wall 2 in such a way that the tabs 11 come to rest in each case between two ribs 8 of the casing cover 5. A screwdriver is then pressed against the cut-out between two tabs 11 of the locking ring 10 and the latter is rotated until the tabs 11 of the locking ring 10 are positioned in the matching grooves of the ribs 8.

The closure system according to the invention is thus distinguished in particular by the fact that, in the closed state, the locking ring 10 is clamped at preferably uniform distances from the ribs 8 of the casing cover 5 and is thus secured radially and axially and also against an undesired deformation. The closure system thus ensures, in a relatively simple manner, that the locking ring 10 is not disadvantageously deformed even at maximum operating pressure and maximum operating temperature and also after a decline in its clamping force and is not forced out of the groove 2*a* of the casing wall 2 by the pump delivery pressure acting on the casing cover 5.

The closure system according to the invention can be modified in various ways. Thus, in the context of the invention and independently of the pump power, it can have different dimensions for casing wall, casing cover and connections.

What is claimed is:

1. A Closure system for pump casings of plastic immersion pumps, the system comprising a substantially cylindrical casing wall; a detachable casing cover, and a locking ring for locking the casing cover in place over an open end of the cylindrical casing, the locking ring being arranged in a mounted state thereof, on the outside of the casing cover and is inserted into an annular groove in the casing wall, wherein the casing cover is provided on an outer side thereof with at least two ribs which are arranged in a spoke-like manner and each having an outer projection defining a groove radially accessible from the outside, and wherein the locking ring is provided with a number of radially inward projecting tabs corresponding to a number of ribs provided on the casing cover, the locking ring being movable into a locking position by rotation on the casing cover, and the tabs being dimensioned and arranged in such a way that, in the locking position, the tabs are each inserted with a tight fit into a respective groove of the ribs.

2. Closure system according to claim 1, wherein the casing cover has six, eight or twelve ribs arranged at regular intervals radially symmetrically to one another, and the locking ring has six, eight or twelve matching tabs.

3. Closure system according to claim 1, wherein width of each tab has a width equal to about ⅔ of an outermost radial spacing of the ribs.

* * * * *